United States Patent [19]

Hankin

[11] Patent Number: 4,481,681

[45] Date of Patent: Nov. 13, 1984

[54] ADJUSTABLE SWEATBAND FOR HEADGEAR

[76] Inventor: Benjamin Hankin, 323 Jefferson Ave., Buffalo, N.Y. 14204

[21] Appl. No.: 367,102

[22] Filed: Apr. 9, 1982

[51] Int. Cl.[3] ..... A42B 1/02; A42B 1/04

[52] U.S. Cl. ..... 2/197; 2/183; 2/195

[58] Field of Search ..... 2/183, 197, 195, 185 R, 2/185 BC

[56] References Cited

U.S. PATENT DOCUMENTS

| | | | |
|---|---|---|---|
| 1,414,797 | 5/1922 | Trau | 2/197 |
| 1,688,013 | 10/1928 | Greenstein | 2/197 |
| 2,447,850 | 8/1948 | Feldman | 2/197 |
| 3,376,580 | 3/1966 | Ashmore | 2/197 |
| 3,513,481 | 5/1970 | Nickerson | 2/197 |
| 4,011,600 | 3/1966 | Malk | 2/183 |

*Primary Examiner*—Henry S. Jaudon
*Assistant Examiner*—Mary A. Ellis
*Attorney, Agent, or Firm*—E. Herbert Liss

[57] ABSTRACT

An adjustable sweatband for uniform caps and the like having a flat generally tubular resilient casing with one open end and one closed end and a vertical opening adjacent the closed end; a semi-rigid regulator strap passing through the casing having one end extending beyond the vertical opening and fixed to the casing and the other end extending beyond the casing open end; and circumferentially spaced tabs on the strap fixed end and circumferentially spaced openings on the strap free end.

4 Claims, 7 Drawing Figures

ADJUSTABLE SWEATBAND FOR HEADGEAR

BACKGROUND OF THE INVENTION

The present invention relates to headgear and, more particularly, to a combined sweatband size regulator which when affixed to the frame of a hat, cap or uniform cap will permit size adjustments to be easily and precisely accomplished without detracting from the appearance of the headgear and without any discomfort to the wearer.

Prior known attempts at size variability in headgear fall into three general categories; namely, elastic or resilient bands, draw-string type arrangements and harness-type devices.

Elastic or resilient bands usually apply a constant constricting inward pressure to the wearer's head and, as such, may be extremely uncomfortable.

Draw-string type devices may include a tubular housing or sheath, fixed to the headgear, which encases an adjustment strap or the like. Both ends of the strap are movable to thereby tighten or loosen the sheath. As both ends of the strap are drawn closer, the sheath tends to "gather", buckle or otherwise distort in circumference and, as a result, the wearer may experience discomfort. Thus, draw-string type devices usually have a very limited range of adjustability; typically on the order of only fractions of a single size.

Harness-type devices are usually suspended from the frame of the headgear and, as such, are movable up and down and side to side with respect thereto. Thus, head movement of the wearer may cause the frame of the headgear to bob and pivot with respect to the harness.

SUMMARY OF THE INVENTION

The foregoing problems and difficulties, as well as others not specifically mentioned, are overcome according to the teachings of the present invention which provides a combined sweatband and size regulator for uniform caps or the like that permits wide variation in size adjustments without any of the disadvantages of previously known arrangements.

More specifically, the present invention includes a generally flat tubular sweatband adapted to be suitably affixed to the frame of the headgear and which houses a size regulator or strap. One end of the strap is fixed to the sweatband, whereas the other end is free to move with respect thereto. Cooperating means are provided on the sweatband and/or fixed strap end and on the movable strap end to permit the movable end to be locked into any one of a plurality of circumferentially spaced positions to thereby afford wide variations in head size adjustability.

The sweatband is made of a suitable soft, cushioned, resilient and stretchable fabric to accommodate circumferential expansion and contraction in response to movement of the regulator strap free end.

The size regulator or strap may be fabricated of a suitable semi-rigid material that will not stretch when pulled nor kink or shrink when pushed, the free end of which may be provided with a plurality of circumferentially spaced openings for interlocking engagement with one or more of a plurality of projecting tabs circumferentially spaced at the fixed end thereof.

The sweatband has a substantially continuous and smooth interior surface that normally engages the wearer's head; with the opposite, exterior surface thereof containing the exposed ends of the regulator or strap.

This exterior surface is normally hidden between the headgear frame and the interior surface. However, when size adjustments are required, the sweatband can be folded "inside-out" to thereby expose the regulator or strap for quick and easy adjustments.

Essentially, then, the present invention comprises a substantially flat tubular casing fabricated of a resilient material, adapted to be affixed along one edge thereof to a headgear frame, said casing having an interior surface adapted to engage a wearer's head that is substantially smooth and continuous and an exterior surface normally facing said frame foldable downwardly therefrom; a regulator strap passing through and substantially enclosed by said casing and having one free end movable with respect to said casing and one stationary end fixed to said casing; and cooperating means on said free end and on one of said stationary end and said casing for locking said free end to said casing at any one of a plurality of circumferentially spaced positions therealong to thereby adjustably vary the circumference of said casing.

Other characterizing features and advantages of the present invention will become readily apparent from the detailed description thereof to follow.

BRIEF DESCRIPTION OF THE DRAWINGS

For a fuller understanding of the present invention reference should now be had to the following detailed description thereof taken in conjunction with the accompanying drawings, wherein.

DETAILED DESCRIPTION OF THE PREFERRED EMBODIMENT

Figure 1:
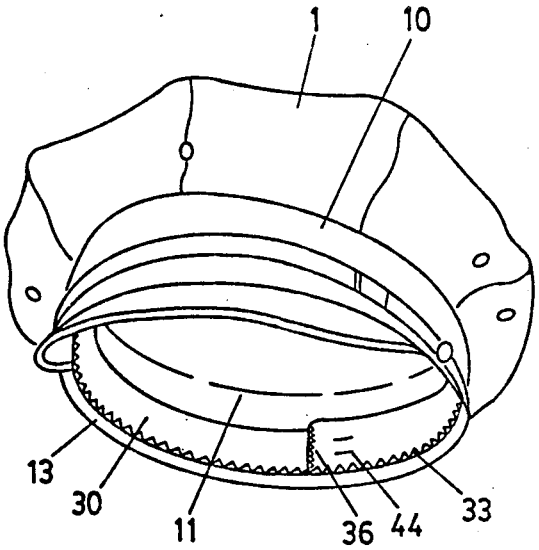
FIG. 1 is a perspective view of a uniform cap incorporating the adjustable sweatband of the present invention.
Figure 2:
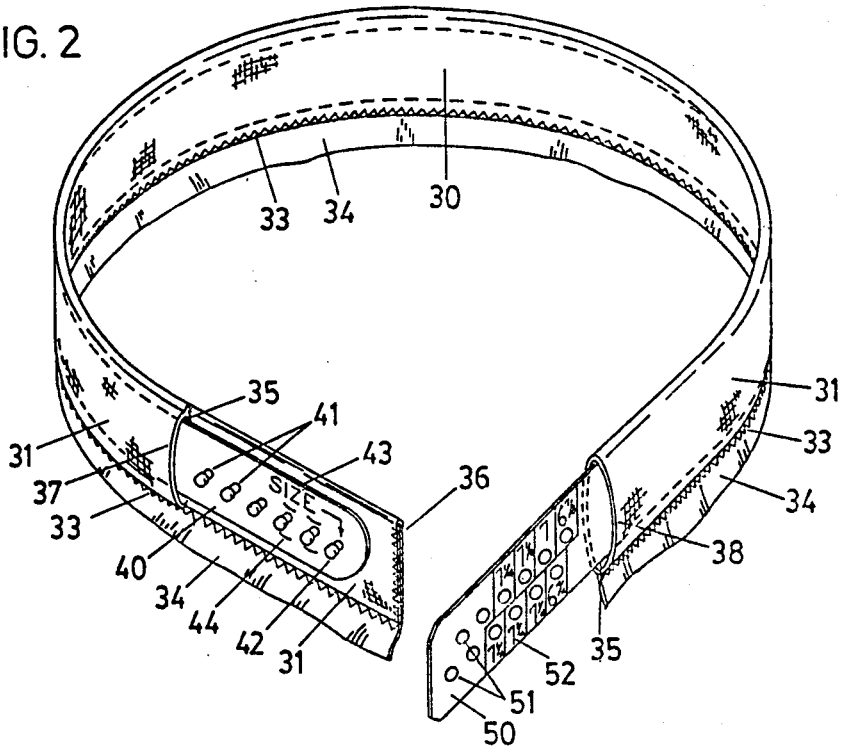
FIG. 2 is a perspective view of the sweatband of FIG. 1 in its normally folded condition and looking downwardly thereat.
Figure 3:
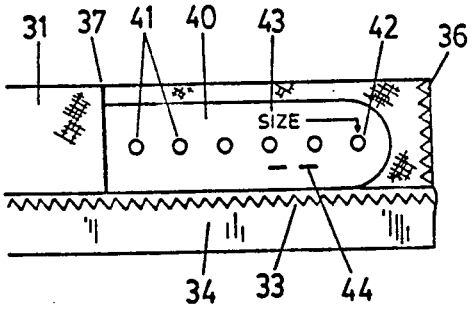
FIG. 3 is a partial fragmentary elevational view of the sweatband of FIG. 2 depicting the stationary or fixed end of the regulator strap.
Figure 4:
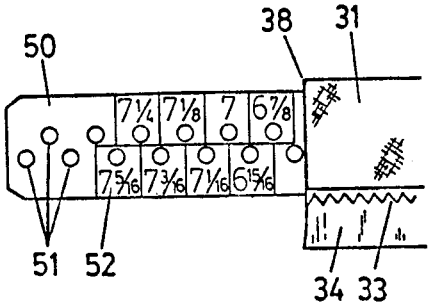
FIG. 4 is a view similar to FIG. 3 but depicting the free or movable end of the regulator strap.
Figure 5:
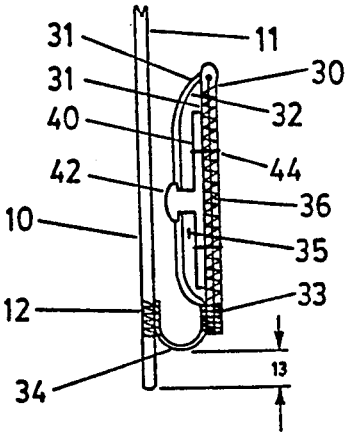
FIG. 5 is a partial fragmentary end view of the sweatband of FIG. 3 depicting the same secured to the frame of the uniform cap of FIG. 1.
Figure 6:
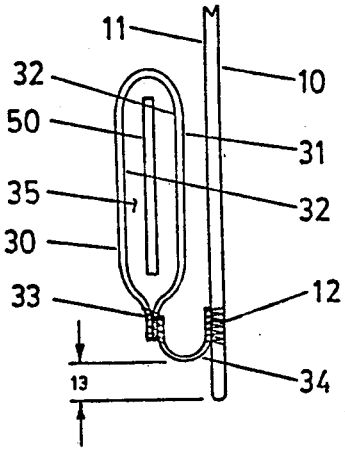
FIG. 6 is a partial fragmentary end view of the sweatband of FIG. 4 depicting the same secured to the frame of the uniform cap of FIG. 1.
Figure 7:
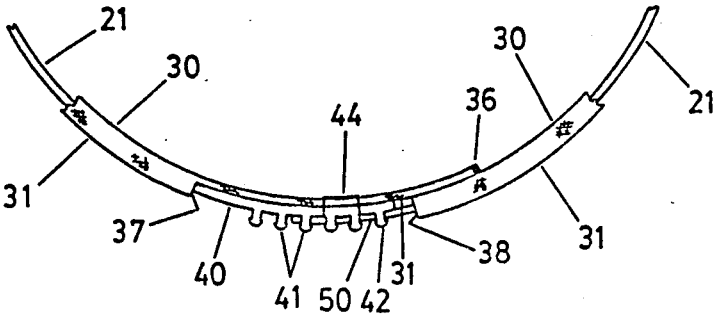
FIG. 7 is a partial fragmentary top view of the adjustable sweatband depicting the cooperating means for securing the free end of the regulator strap to the sweatband casing.

Referring in detail to the drawings, a uniform cap 1 (for illustrative purposes only) is depicted as comprising an exterior perimeter or frame 10 fabricated of any suitable semi-rigid material, to the interior surface 11 of which the adjustable sweatband of the invention may be suitably secured as by stitchings 12 in upward spaced relation from the lower frame edge as shown at 13 (FIGS. 1, 5 and 6).

The sweatband includes a generally flat, tubular casing defining an interior surface 30, adapted in use to engage the wearer's head, and an exterior surface 31 which, in use, normally faces the interior frame surface 11. The sweatband is fabricated of any suitable smooth, soft, resilient and stretchable material such as, for example, expanded vinyl and has an internal channel or conduit 35 defined by an interior surface 32. The channel may be formed by stitching opposite longitudinal edges of the sweatband together as shown at 33. For attachment to cap frame surface 11, an elongated edging 34 may be sewn between the stitching 33 and suitably stitched to and along substantially the entire inner circumference of frame surface 11 as shown at 12 (FIGS. 5 and 6). When sewn to the cap frame, tension is preferably applied to the casing so that it will remain taut and have a smallest circumference no larger than the smallest head size anticipated. The ends of the sweatband overlap such that, when in its folded condition, a substantially continuous surface 30 thereof engages and fits upon a wearer's head. However, the pliability of edging 34 will permit the sweatband to fold "inside-out" and depend below the cap frame for ease in size adjustment, as will become apparent hereinbelow. One end of sweatband channel 35 is suitably closed as by stitches 36, whereas the other end is left open at 38. A substantially vertical cut, opening or slot 37 is provided through surface 31 of the sweatband and is located in close spaced relation to the closed end thereof.

An elongated size regulator strap 21 fabricated of any suitable semi-rigid material, such as plastic, is passed through casing slot 37, along channel 35 and emerges through open end 38. The width of the strap 21 is less than that of the channel to permit easy insertion and movement but not so much less as to permit any undue canting or tilting of the strap with respect to the sweatband. The end 40 of strap 21 adjacent to and projecting out of slot 35 is suitably affixed to casing surface 31 by any known means such as staples 44 and is provided with a plurality of circumferentially spaced projecting size tabs 41; the spacing between each tab corresponding, preferably, to one head size difference. Suitable indicia may be provided, such as the word SIZE and a direction arrow, adjacent the leading tab 42 as a reference to the user in choosing the correct size adjustment; this being depicted at 43. By way of example, the tabs 41 may be spaced approximately $\frac{3}{8}$ of an inch apart, center to center.

The other end or free end 50 of strap 21 projecting outwardly from casing opening 35 is provided with two parallel sets of circumferentially spaced holes 51. Adjacent holes of each set are, preferably spaced a distance equal to one head size. Each of the adjacent holes of the other set are, preferably, staggered with respect to those of the first set such that they are vertically aligned approximately midway therebetween to permit half-size adjustability. Suitable indicia 52 may be provided adjacent each hole of each set to provide an easy indicator of size. It should be noted that the hole sets 51 are in general horizontal alignment with the projecting tabs 41 such that only very slight upward or downward movement is necessary to snap the tabs through any set of holes. It can, thus, be seen that the hole sets 51 and tabs 41 function as cooperating means to lock the free end 50 of strap 21 to the sweatband casing.

The operation of the improved adjustable sweatband of the present invention should be apparent. Thus, when a size adjustment is desired, the sweatband is unfolded to expose the ends 40 and 50 of the regulator strap. The end 50 is pushed or pulled, relative to the fixed end 40, until a hole of either set 51 corresponding to the desired size is aligned with and snapped over the lead tab 42; all other holes of the same set then being snapped over the remaining tabs to provide for a secure and stable attachment. The sweatband is then folded back into the cap frame, leaving only a smooth, cushioned and continuous surface 30 for engagement with the wearer's head. The appearance and "feel" of the sweatband is then similar to those on fixed-size headgear.

Maximum expansion of the sweatband in response to strap movement is limited only by the circumference of the cap frame; whereas, minimum contraction thereof is determined in part by the resiliency of the sweatband casing and in part by the degree of tautness thereof when the same is sewn into the cap frame by the stitching 12.

Although a preferred embodiment of the present invention has been described and disclosed, changes will obviously occur to those skilled in the art without departing from the spirit thereof. It is, therefore, intended that the invention is to be limited only by the scope of the appended claims.

What is claimed is:

1. An adjustable sweatband, comprising: a substantially flat tubular casing fabricated of longitudinally expansible and contractible resilient material, affixed along one edge thereof to a semi-rigid headgear frame with its ends in ovelapping relationship, said casing having an interior surface adapted to engage a wearer's head said casing being substantially smooth and continuous and having an exterior surface normally facing said frame foldable downwardly therefrom:

a semi-rigid regulator strap of greater rigidity than said casing passing through and substantially enclosed by said casing and having one free end movable with respect to said casing and one stationary end fixed to said casing, the ends being in overlapping relationship;

and cooperating engaging means on said free end and said stationary end of said strap for initially locking said free end to said stationary end in a position to place said casing under tension at an initial minimal circumference with said exterior surface of said casing being positioned adjacent said frame said strap being adjustable to any one of a plurality of circumferentially spaced positions by increasing the circumference of said strap whereby the casing will continue to lie adjacent said frame in a smooth, ungathered condition.

2. The sweatband according to claim 3 wherein:

said cooperating means comprises a plurality of circumferentially spaced projecting tabs and a first set of circumferentially spaced openings on one of said free end and said stationary end, disposed for engagement with said projecting tabs to maintain an adjusted position of said sweatband; and indicia on an end to indicate the adjusted size.

3. The sweatband according to claim 2 wherein:

said casing has one closed end and one open end and is provided with a substantially vertical opening close to but spaced from said closed end to provide for overlapping relationship between its ends;

said regulator strap free and projecting beyond said open end;

said regulator strap stationary end being fixedly secured to said casing between said closed end and said opening.

4. The sweatband according to claim 2 wherein:

said cooperating means further includes a second set of circumferentially spaced openings generally parallel to said first set and staggered with respect thereto to provide for half size adjustment.

* * * * *